United States Patent [19]

Coles

[11] 3,986,422

[45] Oct. 19, 1976

[54] ELECTRONIC MUSICAL INSTRUMENT

[76] Inventor: Donald K. Coles, 2505 Capitol Ave., Fort Wayne, Ind. 46806

[22] Filed: Feb. 27, 1975

[21] Appl. No.: 553,798

Related U.S. Application Data

[63] Continuation-in-part of Ser. No. 507,118, Sept. 18, 1974.

[52] U.S. Cl. ..... 84/1.01; 84/423; 84/442; 84/448; 84/451

[51] Int. Cl.[2] ..... G10B 3/20; G10H 5/00

[58] Field of Search ..... 84/1.01, 423, 428, 442, 84/445, 448, 451

[56] References Cited

UNITED STATES PATENTS

| | | | |
|---|---|---|---|
| 2,484,930 | 10/1949 | Cornelius | 84/445 X |
| 3,023,659 | 3/1962 | Bode | 84/445 |
| 3,030,848 | 4/1962 | Wick | 84/445 |
| 3,141,371 | 7/1964 | Coles | 84/448 |
| 3,674,907 | 7/1972 | Derry | 84/1.01 |
| 3,865,004 | 2/1975 | Coles | 84/423 |

*Primary Examiner*—Stanley J. Witkowski

[57] ABSTRACT

The organ plays either a hexatonic scale or the diatonic scale on its front digitals. The organ has a tone transposition apparatus comprising a scale selector apparatus, a key selector apparatus and an absolute pitch changer switch. The key selector apparatus includes a hexachord key selector switch in cascade with a diatonic key selector switch. Each key selector switch is formed by two linear arrays of movable contacts sliding along two linear arrays of stationary contacts. Either of these key selector switches can be set to physically activate key signatures of written music. The key selector apparatus operates on the top octave of tones; lower tones are derived from the top octave by frequency division.

14 Claims, 30 Drawing Figures

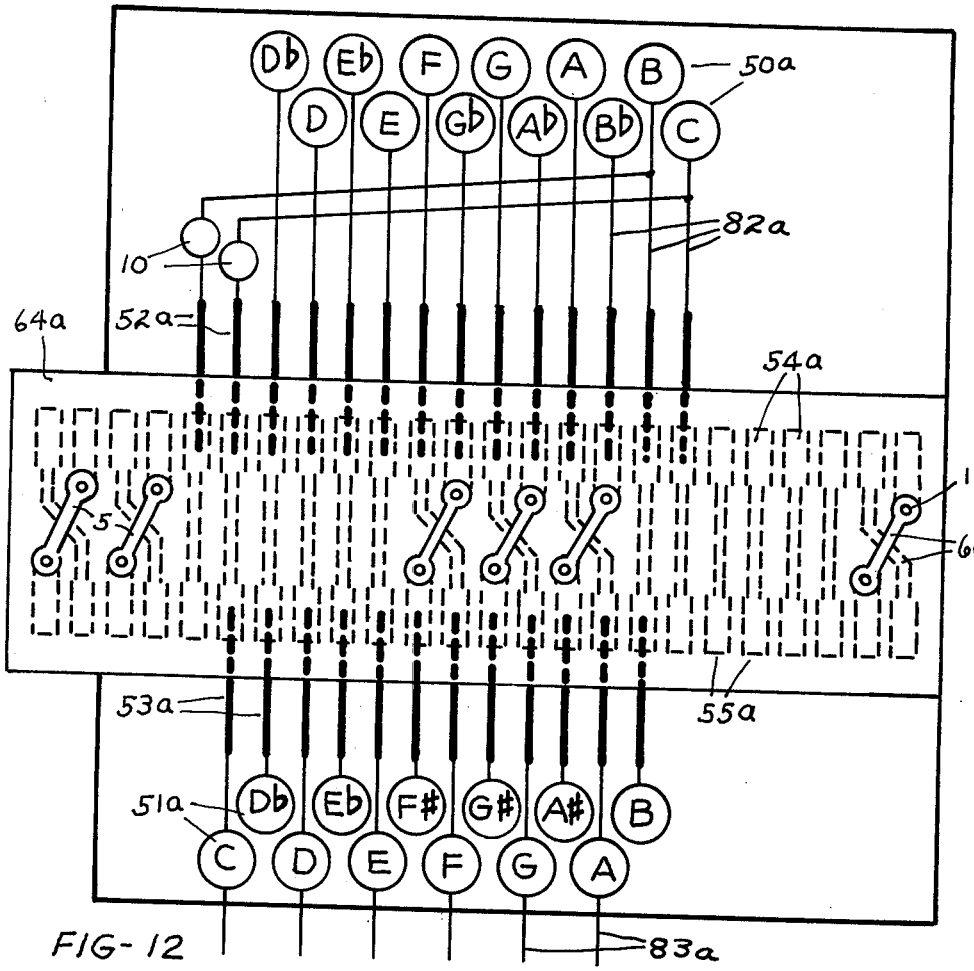
FIG-12
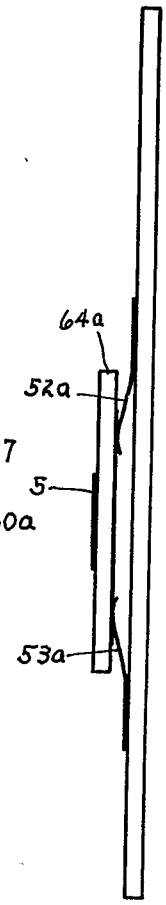
FIG-13
FIG-14
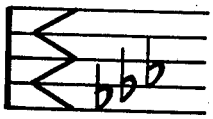
FIG-15
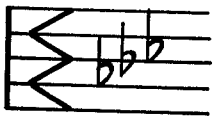
FIG-16
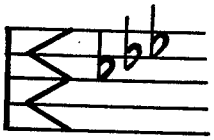
FIG-17
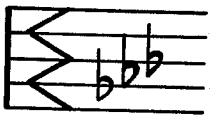
FIG-18
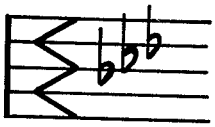
FIG-19
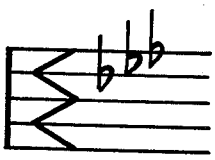
FIG-20
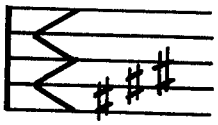
FIG-21
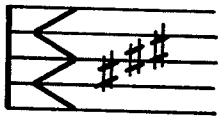
FIG-22
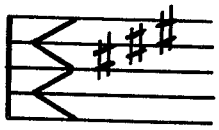
FIG-23
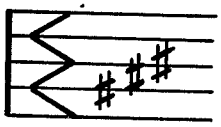
FIG-24
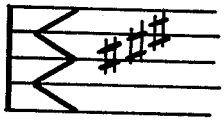
FIG-25
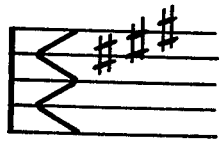

ELECTRONIC MUSICAL INSTRUMENT

CROSS REFERENCE TO RELATED APPLICATIONS

This is a continuation-in-part of my copending application Ser. No. 507,118 filed Sept. 18, 1974.

BACKGROUND OF THE INVENTION

1. Field of the Invention

The key selector apparatus provides means for selecting out of the twelve tones of an octave those needed for any key of the diatonic scale or for any key of the hexachord scale.

2. Description of the Prior Art

Traditionally, keyboard instruments play the diatonic scale on the front digitals of the keyboard and intermediate pitches on the back digitals. The major mode of the diatonic scale starts with a C tone, played on a C front digital. The succeeding D,E,F,G,A,B tones are played on the succeeding D,E,F,G,A,B front digitals. In the traditional system of music notation, the C,D,E,F,-G,A,B tones are represented by symbols on the lines and spaces of a five line staff. An intermediate tone is represented by one of the above notes of the diatonic scale, together with a # or a ♭ symbol serving as a tone correction to that diatonic tone. Thus a tone intermediate to the C and D tone is represented by C # or D♭, and it is played by a back digital position between the C and D front digitals.

For a musical composition to be played on the front digitals of a conventional organ, it must be written in the key of C. Such a restriction severely limits the choice of a composer, for he probably wants to base his composition on the major mode of the diatonic scale starting on a tone above or below the C tone.

In principle there are two ways to move the diatonic scale from one absolute pitch to a different absolute pitch. The preferred way for keyboard instruments would be to specify a movable C major scale in which the pitches played by all digitals are bodily moved a specified distance upward or downward—say four semitones upward. This method has not been available to past composers and their publishers, because most musical instruments have not possessed the pitch changing device which is required for this method. Consequently, composers have resorted to a less satisfactory second method for specifying the absolute pitch of their diatonic scale; they start the major mode of the diatonic scale on one of the other front digitals of the keyboard. This method requires that one or more of the back digitals of the keyboard be included in the diatonic scale.

For a given pitch of the major mode of the diatonic scale, the same back digitals must always be included. Consequently the composer finds it convenient to include these particular sharps or flats in a key signature that is placed at the front of each line of written music. The composer can start the major mode of his diatonic scale on any one of the seven front digitals in an octave span, and he can use either all flats or all sharps with each digital. Thus he uses fourteen different key signatures in addition to the key of C which requires neither sharps nor flats.

The inexperienced player has difficulty remembering and playing all the sharps or flats called for in the key signatures. To alleviate this difficulty, a keyboard instrument can be provided with a device to physically actuate the digital corrections included in the key signature. Such a device, which I call a key selector, can be set to the key signature by the musician; after that he can play the diatonic scale on the front digitals.

Cornelius, in U.S. Pat. No. 2,484,930 has described such a key selector switch interposed between the tone generator circuits and the digital switches. When set for a key signature with two flats, for example, it connects the B and E digital switches to the B♭ and E♭ tone generator circuits. The keyboard contains two extra upper digitals labeled B# and E#, so that when the written music calls for B or E natural, these tones can be obtained by playing the B# or E# upper digital.

While the composer has made known the preferred absolute pitch for his musical composition by the location of his notes on the staff and by his key signature, the keyboard player may wish to use a different absolute pitch. He is likely to have some valid need, such as to accompany a singer or another musical instrument with a limited range of absolute pitch. A change of pitch can be accomplished without changing the key digital if a pitch changer is available which raises the pitch coupled to each digital by a fixed amount, such as four semitones. Many inventors have described pitch changers to be used by the keyboard player for this purpose.

The most satisfactory pitch changing switch is one which can be set to a standard position in which middle A has a fundamental frequency of 440 Hz. The switch preferably has at least eleven other discrete positions in which each pitch is changed from its standard value by an integral number of semitones.

Bode, in U.S. Pat. No. 3,023,659, has described a pitch changing system having a sequence of twenty-three primary tone generators and a twelve pole selection switch which selects a sub-sequence of twelve tone generators. These supply the top octave of tone generators for an electronic organ; lower octaves are derived from the top octave by means of twleve chains of bistable frequency dividers.

The switches that I call pitch changers do not change the musical interval between tones played by adjacent digitals, which I call the interdigital intervals. This characteristic of interdigital invariance distinguishes pitch changing switches from other members of the class of tone transposition switches. So far as I am aware, publically described tone transposition switches all belong to this subclass of interdigital invariant switches, except for the previously mentioned Cornelius key selector and except for my scale selecting switch, disclosed in U.S. Pat. No. 3,141,371. I found that my scale changing switch could not use the Bode trick of pre-divider switching; it belongs to a subclass that requires post-divider switching.

Restriction to the subclass of interdigital invariant switches allows special techniques which are not available to the general class of tone transposition switches. Examples are pitch changers disclosed in U.S. Pat. Nos. 3,836,909 - COCKERELL and 3,610,800 - DEUTSCH. Another example is U.S. Pat. No. 3,030,848 - WICK, in which a linear array of contacts permanently coupled to the digitals slides along a linear array of contacts permanently coupled to the tone actuators.

Pitch changers and Cornelius-type key selectors, which perform quite different functions, are both useful additions to a musical instrument.

I have disclosed an organ with a hexachord keyboard using hexachord notation in my copending patent application number 507,118 filed Sept. 18, 1975. Notation for six-tone scales appears to have important advantages over diatonic notation for players of all musical instruments and especially for singers.

In hexatonic notation, three of the tones are always assigned to lines of the staff; the other three tones are always assigned to spaces. Moreover, positioning of the tones in the upper five-line staff is the same as the positioning in the lower five-line staff.

Recent interest in hexatonic scales has centered on the whole tone scale. This has equal musical intervals of two semitones between each pair of consecutive tones in the scale. The whole tone keyboard, constructed as shown in FIG. 1, has the enormous advantage that any chord can be played at all absolute pitches with only two different fingerings. For teaching music to beginners, however, the whole tone scale has the serious disadvantage that it does not contain the musical intervals of fourths and fifths, which are basic to the early development of music appreciation. And since the tones of the whole tone scale are uniformly spaced, there is no natural basis for development of loyalty to a particular home tone. Up to the present time, no attempt to promote the whole tone keyboard has been widely accepted.

Six-tone scales other than the whole tone scale, which I call "irregular" hexatonic scales, must inherently include at least one musical interval of three or more semitones. One such scale is the hexachord, characterized by the intertone intervals 2-2-1-2-2-3 semitones. An organ with a hexachord keyboard is described in my U.S. Pat. No. 3,865,004.

For teaching music to beginners, I prefer the hexachord scale over the whole tone scale. The hexachord scale includes the musical intervals of fourths and fifths, and its "irregularity" serves as a focal point in tonal development. The hexachord scale is familiar to the ear, since it consists of the first six tones of the diatonic scale. The syllables do-ra-mo-fa-so-la denoting these six tones help to fix three of the tones to lines of the staff and the other three tones to the spaces. The seventh tone of the diatonic scale is notated as C♭, and it is played on a back digital.

In my standard hexachord notation, tones corresponding to lines of the staff constitute the C major triad; tones corresponding to the spaces constitute the D minor triad. When several tones are to be sounded simultaneously, a further dichotomy may be effected by positioning the notes of the tonic major triad on one side of the common stem, and the notes of the supertonic minor triad on the other side of the stem, as indicated in FIG. 2. Thus the standard hexachord notation provides a fixed and intimate association between the written representation and the sounds of music.

The standard hexachord notation is especially suitable for singers, who can sing from the written music at any absolute pitch that suits their voices. Grove's Dictionary of Music, 1954, under "Scale" records the truth "Music is an art not of notes but of intervals." In my standard hexachord notation, the notes are not intended to represent fixed absolute pitches, but only intervals with respect to a C-tone of variable absolute pitch. When singers using standard hexachord notation are accompanied by a piano or organ, the accompanist may read from the same music, for it is now simple and economical to provide an electronic piano or organ with a pitch changing switch.

For a simplified system of musical notation to be considered seriously, some hard questions must be asked, including:

1. Can the system be extended for use by players of all kinds of musical instruments, including those without pitch changers?
2. Can musicians trained in the simplified system easily adapt to music written in the system thus extended?
3. Can musicians trained in the simplified system easily play the large body of printed diatonic music which is stocked and distributed by the music publishing industry?

My invention assists in answering these questions.

SUMMARY OF THE INVENTION

The keyboard of my musical instrument has the same number of front and back digitals. Back digitals alternate with front digitals throughout the length of the keyboard. The instrument has a scale selector apparatus that selects either the diatonic scale or a hexatonic scale to be played on the front digitals. In cascade with the scale selector apparatus is a key selector system assisted by a pitch changing switch.

The key selector system comprises a diatonic key selector sub-system in cascade with a hexachord key selector sub-system. Each key selector sub-system includes a key selector switch which is formed by two interconnected linear arrays of movable contacts sliding along two linear arrays of stationary contacts.

The pitch changer and key selector control tones in the top octave. Tones of lower octaves are derived from the top octave by frequency division. The scale selector comprises a pre-divider switch (to select between the whole tone scale and two arrangements of the hexachord scale) and a post-divider switch (to select between the diatonic scale and the six-tone scales).

BRIEF DESCRIPTION OF THE DRAWINGS

FIG. 12 is a wiring diagram for my hexachord key selector.

FIG. 13 is an end view of my hexachord key selector.

FIGS. 14 to 25 are hexatonic tone signatures.

DESCRIPTION OF THE PREFERRED EMBODIMENT

Figure 1:
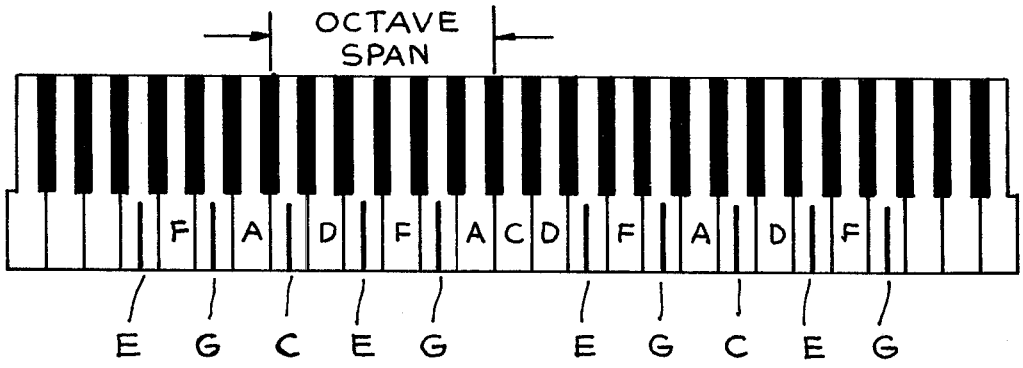
FIG. 1 shows the keyboard of my hexatonic musical instrument.

Referring to FIG. 1, my hexatonic organ has six front digitals and six back digitals per octave span. To avoid ambiguity, I define the octave span as the center-to-center distance between digitals which control tones an octave apart. Although defined as a center-to-center distance, this distance may of course be measured between any corresponding points of the two digitals, or between the cracks to the immediate left or right of the digitals. As shown in FIG. 1, each front digital has a narrow playing surface that extends to the back of the keyboard.

In order to avoid other ambiguities, I generally use the terms "tone" and "pitch" in a relative way to describe a musical sound relative to other tones in a sequence. When I mean pitch in an absolute sense, I use the specific terms. A sequence of relative tones may be defined by the intertone intervals between consecutive tones of the sequence. A musical scale is characterized by the intertone intervals between its adjacent tones, not by their absolute pitch. The number of intertone intervals defining a scale is equal to the number of tones in the scale, the last intertone interval being measured between the highest tone of the scale and an exterior tone which is one octave above the lowest tone of the scale. Thus the sum of the intertone intervals defining a musical scale is equal to twelve semitones.

I reserve the term "note" for the symbol on a staff which is used to specify a digital and the tone it activates. When a staff is used to record music in a particular system of notation, each musical tone is indicated by a note positioned on the staff.

Starting at the left of the octave span shown in FIG. 1, the six front digitals included in the octave span are labeled C,D,E,F,G,A. The digitals labeled C,E,G always fall on lines of the upper and lower staves; digitals labeled D,F,A always fall on spaces between the lines. FIG. 1 shows five-line groups engraved on the front digitals to serve as landmarks directly representative of the five-line staves.

Figure 2:
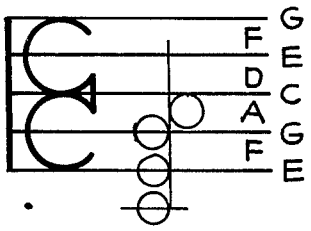
FIG. 2 shows the hexachord scale sign and staff.
Figure 3:
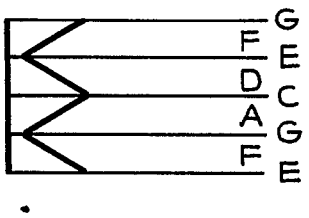
FIG. 3 shows the whole tone scale sign and staff.

The scale sign used for the hexachord notation is shown in FIG. 2, which also shows the labels assigned to the lines and spaces of both upper and lower staves. The hexachord scale sign is used in teaching beginners, and in music for vocalists and instruments with pitch changers. FIG. 3 shows the scale sign used for the whole tone notation, and the same assignment of labels to the lines and spaces of both upper and lower staves. The whole tone scale sign is used in teaching harmony, and in music for instruments without pitch changers.

Figure 5:
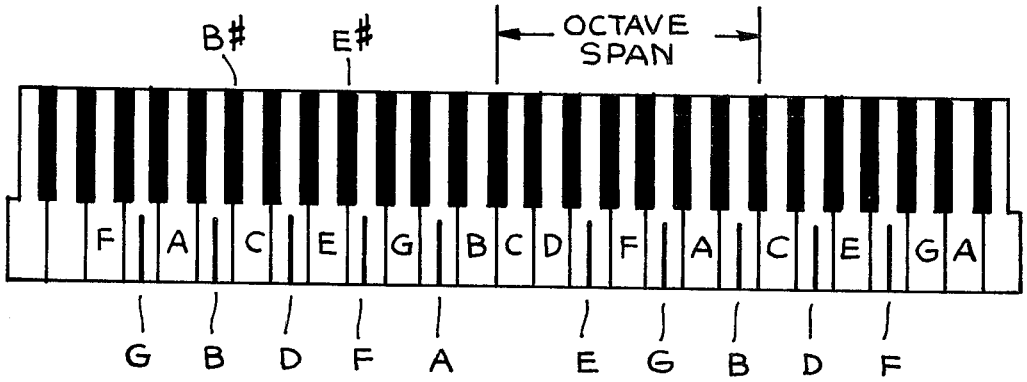
FIG. 5 shows diatonic notation for my keyboard.

My organ is provided with a scale selecting apparatus to select between the hexachord scale and the whole tone scale. In order to play conventionally written music, the scale selecting apparatus can also be set for the diatonic scale. When the scale selecting apparatus is set for the diatonic scale, the conventional labels for the front digitals are as shown in FIG. 5. A player trained in the hexatonic system need not learn these labels (or any labels); he can play either hexatonic or conventional music by observing the relationship of the written notes to the five-line staves, which are also engraved on the keyboard.

In order to help an inexperienced player perform conventionally written music in the absolute pitch that the composer has chosen, my organ has a diatonic key selector which physically actuates the tone corrections substitutions called for by the composer in his key signature.

Figure 4:
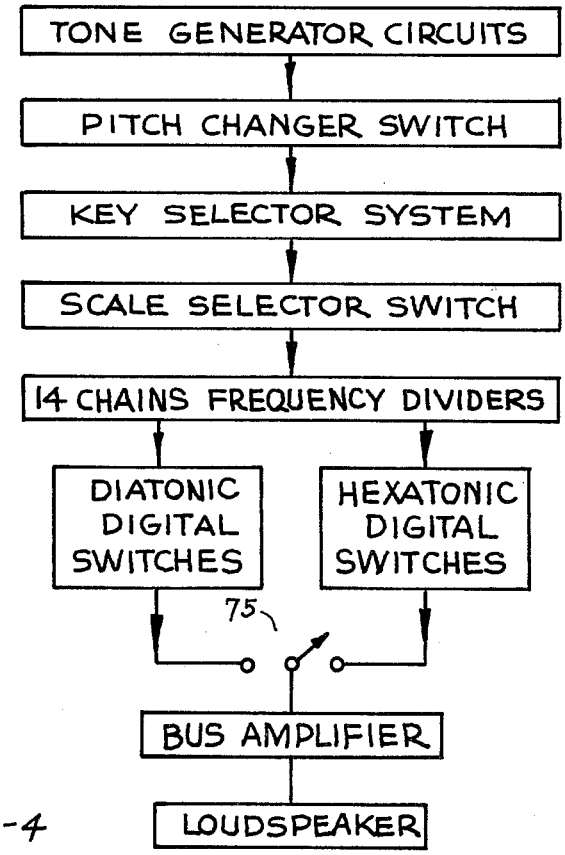
FIG. 4 is a block diagram of my musical instrument.

FIG. 4 shows the relationship of my key selector system to other parts of the organ. Referring to FIG. 4, the key selector system is coupled via a scale selector switch and fourteen chains of frequency dividers to two sets of digital switches. The output from one of the sets of digital switches is coupled to an amplifier and loudspeaker. The key selector is also coupled via a pitch changer switch to the primary tone generator circuits, which, by means of frequency division, provide tones to be played by all digitals of the keyboard.

Each digital of the keyboard has attached to its under surface two digital switches. One of these digital switches is used for the diatonic scale, the other is used for the six-tone scales. When the scale selector apparatus is set for the diatonic scale, the seven front digitals in each octave span of the keyboard play the seven tones C,D,E,F,G,A,B of the diatonic scale. When the scale selector apparatus is set for the hexachord scale, the six front digitals in each octave span of the keyboard play the six tones C,D,E,F,G,A of the hexachord scale.

Referring still to FIG. 4, the twenty three tone generator circuits are contained in two integrated circuit packages of type MK50242, manufactured by the Mostek Corporation. The inputs to these two packages are connected to the second and third stage outputs from a chain of frequency dividers, contained in an integrated circuit package of type SCL4024A, manufactured Solid State Scientific, Inc. The input of this in turn is connected to a crystal controlled oscillator of type S14R-2, manufactured by the Connor-Winfield Corporation. This oscillates at a frequency of 5.342 MHz.

Referring to FIG. 4, the pitch changer, key selector and scale selector are described later. Each chain of frequency dividers is contained in an integrated circuit package of the aforementioned SCL4024A type. Thi package has a single audio input and seven outputs at frequencies below the input frequency by factors of 2,4,8,16,32,64 and 128. Thus the chain whose input is C at 2093 Hz produces outputs of C at 1046 Hz, 523 Hz, 262 Hz, and so on.

The outputs from all the chains of frequency dividers cannot be connected to a single set of digital switches with both twelve digitals per octave span, and fourteen digitals per octave span. If they were so connected, most of the digitals would play two tones at once. Therefore, separate sets of digital switches are used for musical scales with different numbers of digitals per octave span. The switch 75 of FIG. 4 selects the busbar from one of these two sets of digital switches to be connected to the bus amplifier and loud-speaker.

Digital switches, amplifier, and the loud-speaker shown in FIG. 4 are conventional units. Their method of assembly in an organ is well known to the skilled artisan. By means of the pitch changer switch shown in FIG. 4, the keyboard player can independently raise or lower the absolute pitch of the musical composition while performing the fingering called for in the written music.

Figure 6:
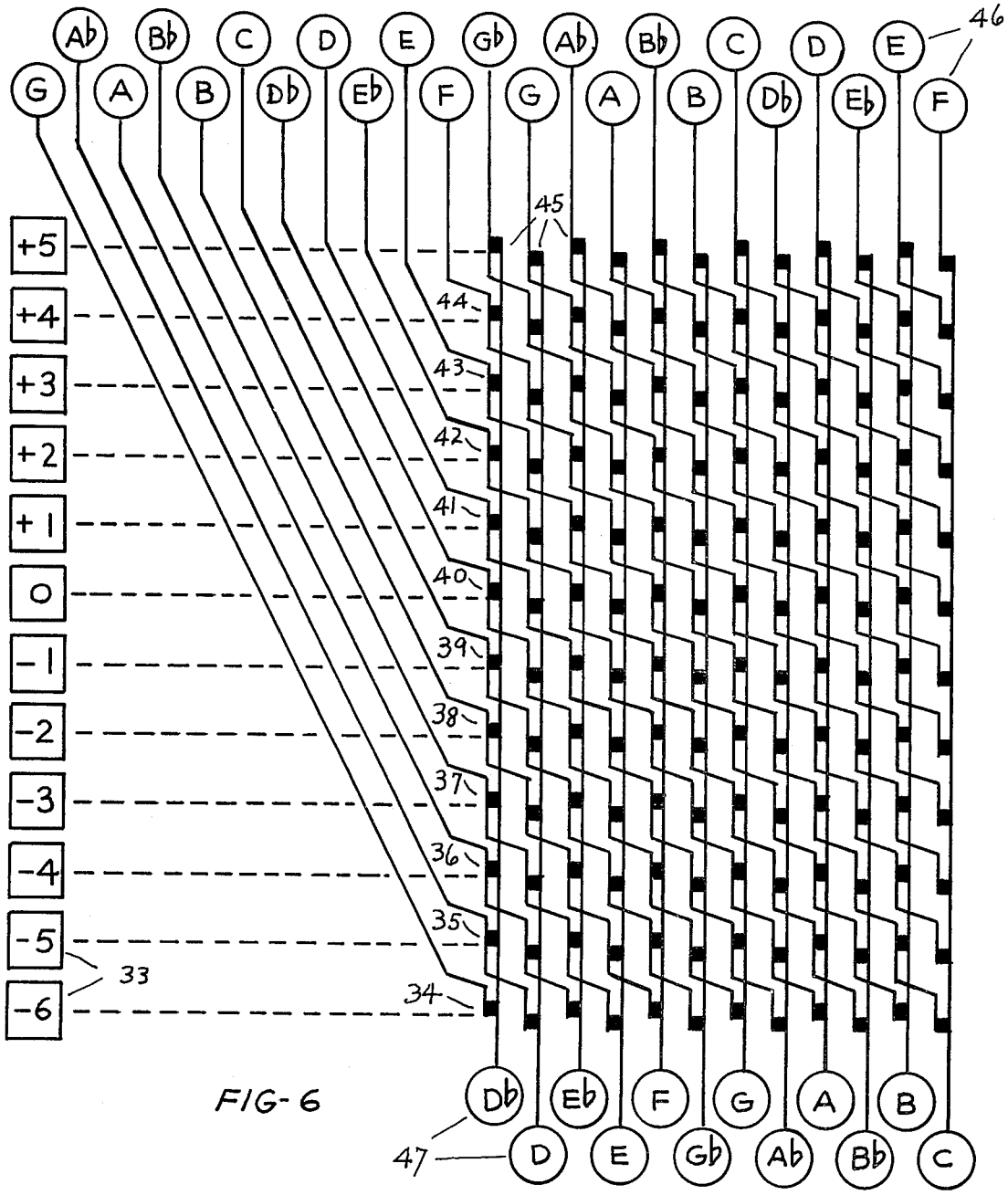
FIG. 6 is a wiring diagram for my pitch changer.

Referring to FIG. 6, showing an absolute pitch changing switch, both the tone terminals 46 and digital terminals 47 are identified by tone labels used traditionally in the United States. Tone terminals 46 are connected to a sequence of twenty-three electronic tone generators having absolute pitches proceeding from G at a frequency of about 1568 Hz to F at a frequency of about 5588 Hz. By means of the pitch changing switch, a sequence of twelve of these tone generators is selected. The square wave shape of the tone generator output is suitable for frequency division by methods well known in the electronic organ industry.

Referring to FIG. 6, pushbuttons 33 are inter-connected so that only one of them can be a activated at a time. When one pushbutton is depressed, it latches down and releases the previously latched pushbutton. The pushbutton marked 0 closes the array of contacts 40, the pushbutton marked +1 closes the array of contacts 41, and so on. Tone terminals 46 are connected to digital terminals 47 through one of the twelve arrays of switches 34....45.

When the standard array of contacts 40 is closed, the C digital terminal is connected to the C tone terminal, the D digital terminal is connected to the D tone terminal, and so on. When the array of contacts 41 is closed, the same digital terminals are each connected to tone terminals which produce absolute pitches one semitone higher. Absolute pitch selecting switches for keyboard instruments are well known. A switch of the type shown in FIG. 6 is disclosed in U.S. Pat. No. 3,023,659 - BODE. A glance at FIG. 6 shows that the absolute pitch is changed by the same amount at each output terminal. For example, in changing from the +1 switch state to the +3 switch state, the pitch at each output terminal is raised two semitones.

Pitch changing switches do not change the interdigital intervals between tones played by adjacent digitals. The interdigital interval between the E and F digitals, for example, is one semi-tone in the +1 switch state; it is also one semi-tone in the +3 switch state.

The invariance of all interdigital intervals when the switch changes states is a characteristic property of absolute pitch changing switches which distinguishes them from other kinds of tone transposition switches.

Operation of the pitch changing switch does not necessarily affect the naming of the musical tones that result. For example, in FIG. 1, the G digital may be struck, and the resulting tone may be called G regardless of which pitch changer state is activated. When a pitch changer is available, it is more helpful to describe a tone by its position in the movable C major scale, rather than by a scheme of absolute pitch. The two descriptions coincide when the pitch changer is in its standard state.

Figure 9:
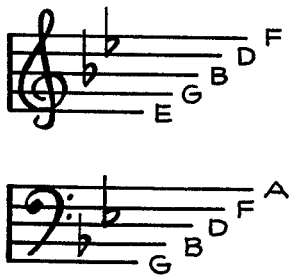
FIGS. 9, 10 show diatonic key signatures.
Figure 10:
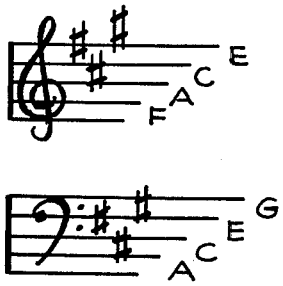

Typical key signatures for diatonic music are shown in FIGS. 9 and 10, which call for two flats and three sharps respectively. FIG. 9 indicates that the two back digitals B♭ and E♭ should be fingered instead of the two front digitals B and E. FIG. 10 indicates that the three back digitals F♯, C♯ and G♯ should be fingered instead of the three front digitals F,C, and G.

We are using here the conventional labels for the digitals, but the player need not consider the labels, since the correct digital can be selected by its position with respect to the lines of the staff (also engraved on the keyboard), without considering its label.

Figure 7:
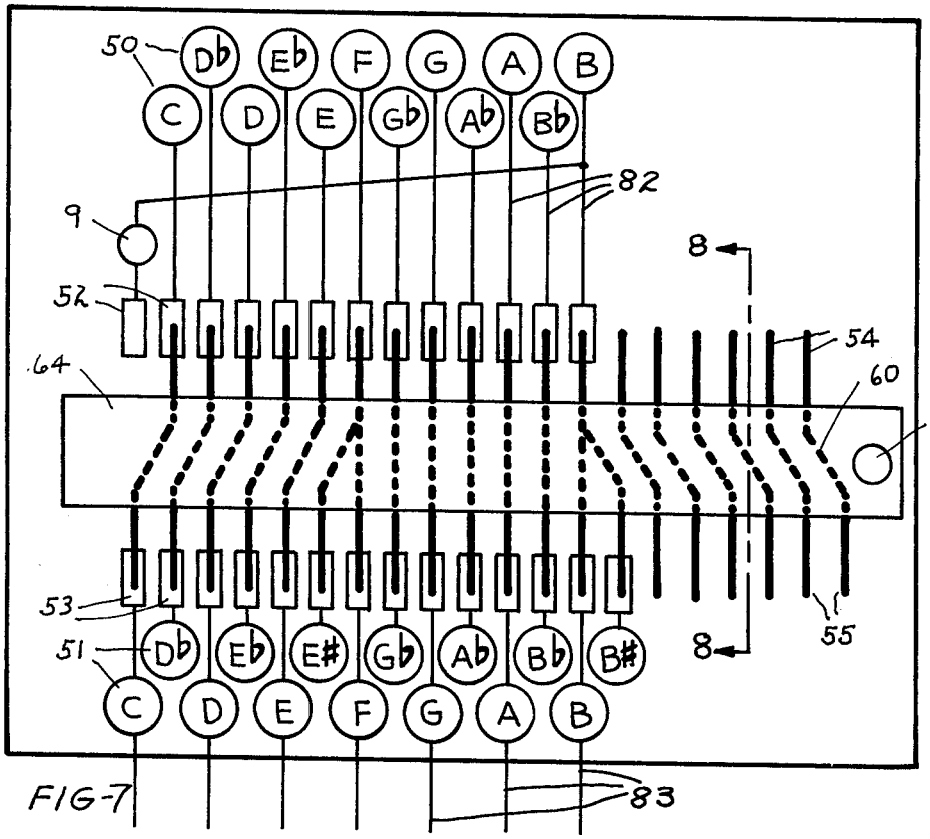
FIG. 7 shows my diatonic key selector.

FIG. 7 is a diagram of my diatonic key selector subsystem. Tone terminals 50 are identified by the traditional tone labels. These twelve tone terminals run from C up eleven steps to B. A thirteenth tone, derived from the top B tone by means of a bistable frequency divider 9, is needed for playing in six flats. The set of thirteen primary tone generator circuits is connected to an array of stationary tone contacts 52 by means of input leads 82.

Digital terminals 51 bear the conventional labels for the tones they carry when this switch is in its standard state shown in FIG. 7. This state corresponds to the key of C, provided that the preceding pitch changer and hexachord key selector are also in their standard states. One half of these fourteen digital terminals 51 provide tones played by the front digitals of the keyboard, the other half provide tones played by the back digital of the keyboard. All of these terminal labels serve a useful purpose in connecting together different parts of my tone transposition apparatus, but the terminals are not permanently associated with particular absolute pitches, nor with particular tones, nor with particular digitals. The terminal labels do give the correct tones when the pitch changer, the hexachord key selector, and the diatonic key selector are in their standard positions, corresponding to standard absolute pitch and the key of C.

Figure 8:
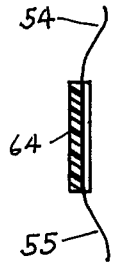
FIG. 8 is a cross sectional view of my diatonic key selector.

Referring to FIG. 7, stationary tone contacts 52, are uniformly spaced in a straight line. Stationary digital contacts 55 are equally spaced in a parallel line. Sliding along the line of stationary tone contacts is a line of ganged movable tone contacts 54, and sliding along the line of stationary digital contacts is a line of ganged movable digital contacts 55. Movable conductors 60 connect twelve movable tone contacts per octave to fourteen movable digital contacts per octave. The movable contacts and conductors are mounted on a movable carriage 64. A cross sectional view of the movable carriage is shown in FIG. 8.

The movable conductors are etched from a springy material such as beryllium copper, and their center parts cemented to a common insulating board. A thin coat of rhodium is plated onto the ends of the conductors to provide durable contact surfaces at each end.

By means of a handle 61, the assembly of movable contacts and their inter-connections can be moved along the parallel lines of stationary contacts into seven separate operating positions. These include the standard position shown in FIG. 7 and six positions to the left corresponding to a key signature containing flats increasing in number from one to six as carriage 64 moves progressively to the left. In the standard position and consecutive positions to the left, the tones carried by the sequence of output leads 83 bear the conventional labels:

| | | | | | | |
|---|---|---|---|---|---|---|
| C | D | E | F | G | A | B, |
| C | D | E | F | G | A | B♭, |
| C | D | E♭ | F | G | A | B♭, |
| C | D | E♭ | F | G | A♭ | B♭, |
| C | D♭ | E♭ | F | G | A♭ | B♭, |
| C | D♭ | E♭ | F | G♭ | A♭ | B♭, |
| C♭ | D♭ | E♭ | F | G♭ | A♭ | B♭. |

These seven sequences constitute one representation of the seven cyclic modes of the diatonic scale. Another representation of the same cyclic modes, using only sharps, is respectively:

| | | | | | | |
|---|---|---|---|---|---|---|
| C | D | E | F | G | A | B, |
| C♯ | D♯ | E♯ | F♯ | G♯ | A♯ | B, |
| C♯ | D♯ | E | F♯ | G♯ | A♯ | B, |
| C♯ | D♯ | E | F♯ | G♯ | A | B, |
| C♯ | D | E | F♯ | G♯ | A | B, |
| C♯ | D | E | F♯ | G | A | B, |
| C | D | E | F♯ | G | A | B. |

The cyclic modes of a seven tone scale may be defined as sequences of the seven relative tones in the same cyclic order but starting on different tones of the scale. Thus a third representation of the above cyclic modes is, respectively:

| | | | | | | | | | | | | |
|---|---|---|---|---|---|---|---|---|---|---|---|---|
| C | - | D | - | E | - | F | - | G | - | A | - | B, |
| G | - | A | - | B | - | C | - | D | - | E | - | F, |
| D | - | E | - | F | - | G | - | A | - | B | - | C, |
| A | - | B | - | C | - | D | - | E | - | F | - | G, |
| E | - | F | - | G | - | A | - | B | - | C | - | D, |
| B | - | C | - | D | - | E | - | F | - | G | - | A, |
| F | - | G | - | A | - | B | - | C | - | D | - | E. |

Since the differrent cyclic modes of a musical scale are characterized by relative pitches only, the above cyclic modes of the diatonic scale are fully defined by their respective sequence of intertone intervals:

| |
|---|
| 2-2-1-2-2-2-1 semitones, |
| 2-2-1-2-2-1-2 semitones, |
| 2-1-2-2-2-1-2 semitones, |
| 2-1-2-2-1-2-2 semitones, |
| 1-2-2-2-1-2-2 semitones, |
| 1-2-2-1-2-2-2 semitones, |
| 2-2-2-1-2-2-1 semitones, |

Referring still to FIG. 7, the conventional labels for tones carried on output leads 83 are shown in Table 1. Column 1. Table 1 shows the seven sequential positions of the switch, which correspond to the number of flats in different key signatures containing flats. Column 2 gives the names assigned by the ancient Greeks to the seven modes of their diatonic scale. The modern names of two of the cyclic modes (major and minor) are also included in Column 2.

TABLE 1

| Number of Flats in Signature | Mode Name | Intertone Intervals | Key of Major Mode |
|---|---|---|---|
| 0 | Lydian, Major | *2-2-1-2-2-2-1 | C |
| 1 | Hypophrygian | -2-2-1*2-2-1-2 | F |
| 2 | Phrygian | -2-1-2-2-2-1*2 | B♭ |
| 3 | Hypodorian, Minor | -2-1*2-2-1-2-2 | E♭ |
| 4 | Dorian | -1-2-2-2-1*2-2 | A♭ |
| 5 | Mixolydian | -1*2-2-1-2-2-2 | D♭ |
| 6 | Hypolydian | -2-2-2-1*2-2-1 | G♭ |

Column 3 of Table 1 shows the intertone intervals in semitones for the different modes. The asterisk represents the key tone of the major mode. Each cyclic mode coupled to the set 83 of output leads is associated with a different starting digital for the major mode on the keyboard. The key tone, played by the key digital when the pitch changer is in its standard position, is shown in column 4 of Table 1.

The same key selector switch positions that actuate from 0 to 6 flats can also be used to actuate from 7 to 1 sharps respectively. To accomplish this, the pitch changer is moved from its standard position to the +1 position. Furthermore, the standard key selector position can also activate a key signature with seven flats, if the pitch changer switch is moved to the −1 position. Table 2 serves as a guide for selecting switch positions to actuate key signatures having different numbers of flats and sharps. The symbols of Table 2 are positioned near the handle of the key selector switch, to serve as a guide for positioning the key selector and pitch changer switches.

TABLE 2

| Pitch Changer Position | Number of Flats or Sharps | | | | | | | |
|---|---|---|---|---|---|---|---|---|
| 0 | ♭ | 6 | 5 | 4 | 3 | 2 | 1 | 0 |
| +1 | ♯ | 1 | 2 | 3 | 4 | 5 | 6 | 7 |
| −1 | ♭ | — | — | — | — | — | — | 7 |

Quadruple linear array switches can also be used for other purposes.

Table 3 shows the detailed tone corrections that are produced for different positions of the diatonic key selector and the pitch changer switches. Of the fifteen key signatures, only twelve are needed to specify pitch. Three redundant keys are shown in Table 3 separated from the other twelve keys by horizontal lines. In addition, eight uniform pitch changes are produced by using separate sharp and flat key signatures for diatonic modes that differ uniformly in pitch by a single semitone.

My switching arrangement eliminates all of the above redundancies by separating changes which preserve interdigital interval invariance from changes that destroy the invariance. Thus the combination of my seventstate key selector with a twelve-state pitch changer provides $12 \times 7 = 84$ diatonic switch states which are all distinct from each other. The eighty four switch states provide the seven different diatonic modes at each of twelve different absolute pitches.

TABLE 3

| Key Tone | Key Selector Position | Pitch Changer Position | Tone Corrections |
|---|---|---|---|
| C | 0 | 0 | — |
| F | −1 | 0 | B♭ |
| B♭ | −2 | 0 | B♭, E♭ |
| E♭ | −3 | 0 | A♭, B♭, E♭ |
| A♭ | −4 | 0 | A♭, B♭, D♭, E♭ |
| D♭ | −5 | 0 | G♭, A♭, B♭, D♭, E♭ |
| G♭ | −6 | 0 | G♭, A♭, B♭, C♭ = B, D♭, E♭ |
| C♭ | 0 | −1 | G♭, A♭, B♭, C♭ =B, D♭, E♭, F♭ =E |
| C♯ | 0 | +1 | F♯, G♯, A♯, B♯ = C, C♯, D♯, E♯ = F |
| F♯ | −1 | +1 | F♯, G♯, A♯, C♯, D♯, E♯ = F |
| B | −2 | +1 | F♯, G♯, A♯, C♯, D♯ |
| E | −3 | +1 | F♯, G♯, C♯, D♯ |
| A | −4 | +1 | F♯, G♯, C♯ |
| D | −5 | +1 | F♯, C♯ |
| G | −6 | +1 | F♯ |

When music is written in the hexachord scale for instruments without pitch changers, twelve different hexachord key signatures of some kind are needed. For the key of G, which requires one sharp in diatonic notation, the tone corrections in hexachord notation would be C♭, D♭♭, E♭♭, F♭. An alternative key signature for the same key would require three double sharps. Such tone corrections would be difficult to make. For the key of E, which in diatonic notation requires four sharps, the hexachord key signature would be F♯, G♯, C♭, D♭. These tone corrections, made up of sharps and flats together, would also be difficult to make. A more satisfactory method of specifying these needed tone corrections is described later.

Figure 27:
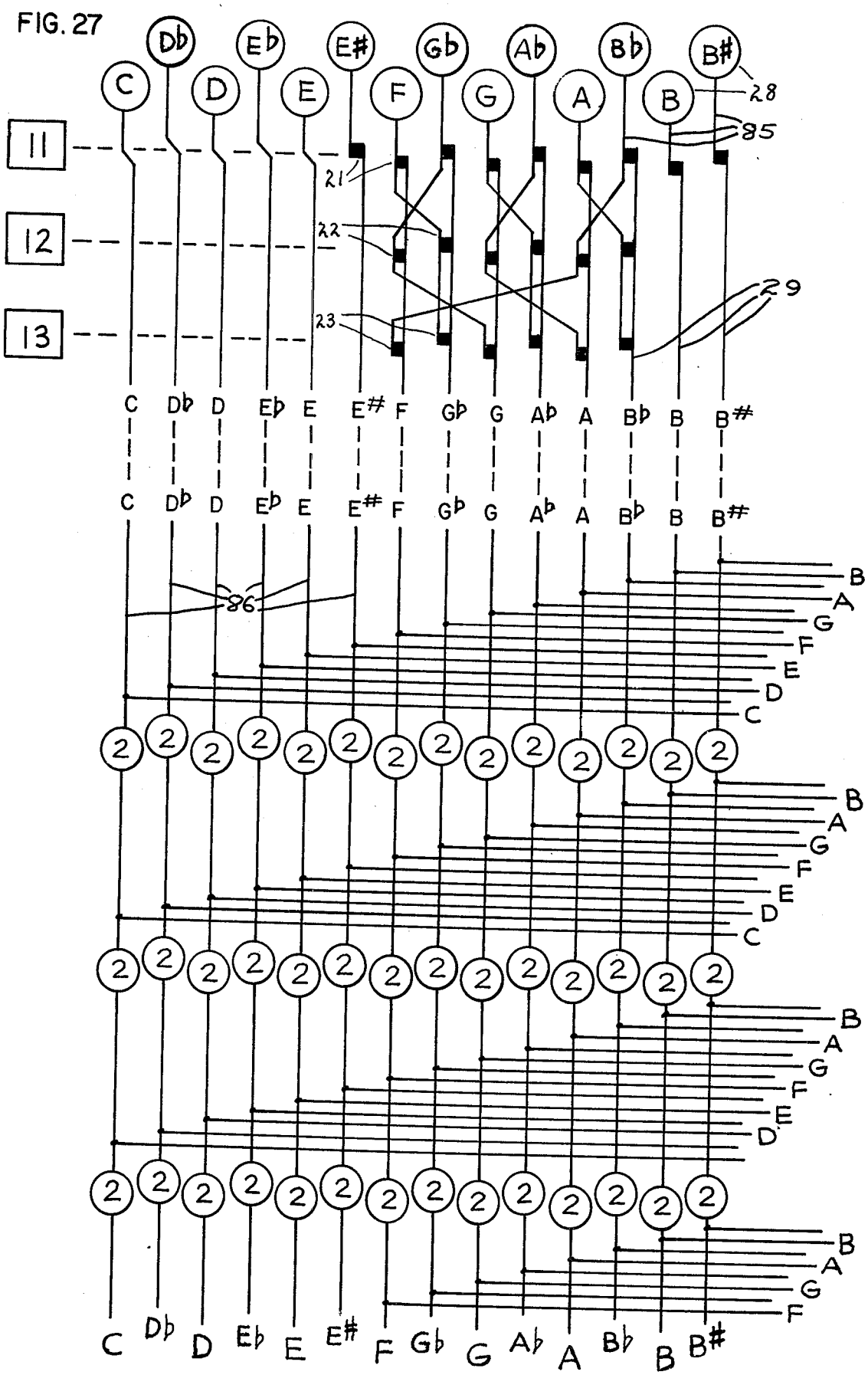
FIGS. 27, 28 are wiring diagrams for my scale selector system.

I have constructed a hexachord key selector sub-system to actuate the twelve different key signatures. This is shown in FIG. 12. When this key selector is in use, it is necessary to depress the hexachord pushbutton 12 of the scale selector (FIG. 27).

Referring to FIG. 12, a sequence of tone terminals 50*a* are identified by the traditional tone labels. These twelve tone terminals run from D♭ up eleven steps to C. Frequency dividers 10 derive two extra tones B and C at the low frequency end of the sequence. The set of fourteen primary tone generator circuits is connected to an array of stationary tone contacts 52*a* by means of input leads 82*a*. In this case the stationary contacts are spring contacts, as shown in the end view of FIG. 13.

Digital terminals 51*a* bear the conventional labels for the tones they carry when this switch is in its standard state, shown in FIG. 12. This state corresponds to the absolute key of C, provided that the preceding pitch changer is in its standard state. Even for other states of the pitch changer, this state of the key selector may be said to correspond to the relative key of C on the digital terminals 51*a*. The tones G♭, A♭, B♭, are identical to the tones F♯, G♯, A♯ respectively.

One half of the twelve digital terminals 51*a* supply tones to be played by the front digitals of the keyboard, the other half supply tones for the back digitals of the keyboard.

Referring again to FIG. 12, a first set of ganged movable contacts 54*a* and a second set of ganged movable contacts 55*a* slide along two linear arrays of stationary contacts 52*a* and 53*a*. When the switch is in its standard position, shown, the interconnections 60*a* between the two sets of movable contacts result in a hexachord scale on the set of six output leads 83*a*, which carry tones to be played by the front digitals of the keyboard. As the assembly of movable contacts and their interconnections moves from the standard position, the hexachord scale moves along the keyboard.

For a hexachord keyboard to accommodate all twelve tones of the chromatic scale, some of the tones must be out of order on the keyboard; hence the crossover of some of the movable conductors 60*a*. These crossovers are accomplished by etching conductors 5 (FIG. 13) on the back side of the printed circuit board 64*a*. Connection to these back-side conductors is made by means of plated-through holes 17 — a process well known in the printed circuit industry.

Referring still to FIG. 12, the assembly of movable contacts 54*a*, 55*a*, and movable conductors 60*a* can move from the standard position five steps to the right and six steps to the left. This allows a total of twelve switch positions, corresponding to the number of independent keys of the hexachord scale in which a musical composition can be written. Adjacent switch positions produce keys separated by a musical interval of a fifth, exactly as in the diatonic key selector.

In the standard position and five consecutive carriage positions to the right in FIG. 12, the tones carried by the output leads 83*a* are, in the conventional notation:

| | | | | | | | | | | | |
|---|---|---|---|---|---|---|---|---|---|---|---|
| C | - | D | - | E | - | F | - | G | - | A, |
| C | - | D | - | E | - | G | - | A | - | B, |
| B | - | D | - | E | - | G♭ | - | G | - | A, |
| D♭ | - | D | - | E | - | G♭ | - | A | - | B, |
| B | - | D♭ | - | E | - | G♭ | - | A♭ | - | A, |
| D♭ | - | E♭ | - | E | - | G♭ | - | A♭ | - | B. |

These sequences are different cyclic modes of the hexachord scale. These six cyclic modes are defined by their respective sequences of intertone intervals:

2-2-1-2-2-3 semitones,
2-2-3-2-2-1 semitones,
3-2-2-1-2-2 semitones,
1-2-2-3-2-2 semitones,
2-3-2-2-1-2 semitones,
2-1-2-2-3-2 semitones.

The six sequences constitute a complete set of cyclic modes of the hexachord scale.

In the six progressive carriage positions to the left of the standard position in FIG. 12, the tones carried by the output leads 83*a* are, in the conventional notation:

| | | | | | | | | | | | |
|---|---|---|---|---|---|---|---|---|---|---|---|
| C | - | D | - | F | - | G | - | A | - | B♭, |
| C | - | D | - | E♭ | - | F | - | G | - | B♭, |
| C | - | E♭ | - | F | - | G | - | A♭ | - | B♭, |
| C | - | D♭ | - | E♭ | - | F | - | A♭ | - | B♭, |
| D♭ | - | E♭ | - | F | - | G♭ | - | A♭ | - | B♭, |
| B | - | D♭ | - | E♭ | - | G♭ | - | A♭ | - | B♭, |

These six sequences of tones constitute another complete set of six cyclic modes of the hexachord scale, defined by their respective sequences of intertone intervals:

2-3-2-2-1-2 semitones,
2-1-2-2-3-2 semitones,
3-2-2-1-2-2 semitones,
1-2-2-3-2-2 semitones,
2-2-1-2-2-3 semitones,
2-2-3-2-2-1 semitones.

A comparison of the interdigital intevals for carriage positions to the right and to the left in FIG. 12 shows that each cyclic mode is duplicated. Inspection of the two absolute pitches for the same cyclic mode shows that there is always a one-semitone interval between the two absolute pitches; the twelve positions of the carriage provide twelve different absolute pitches for the hexachord scale.

For the hexatonic system to be useful, the above diatonic notation for the tones must be converted into a hexatonic notation which does not include B, but which includes all six of the labels C,D,E,F,G,A. One difficulty is apparent already in the diatonic notation; the label sequence corresponding to the first step to the right has no F label. This kind of omission can be corrected by means of a notation using double sharps or double flats. The result obtained by using double sharps is shown in Table 4.

The tone corrections to the hexachord scale which are produced when the key selector is moved from its standard position are given in Table 4, in standard hexachord notation.

TABLE 4

| Key Selector Position | Key Tone (Hexachord Notation) | Tone Corrections (Hexachord Notation) |
|---|---|---|
| +5 | Aχ=C♭ | C♯ ,D♯ ,F♯ ,G♯ ,Aχ=C♭ |
| +4 | E | F♯ ,G♯ ,C♭ ,D♭ |
| +3 | Gχ=A | C♯ ,F♯ ,Gχ=A,Aχ=C♭ |
| +2 | D | F♯ ,C♭ |
| +1 | Fχ=G | Fχ=G,Gχ=A,Aχ=C♭ |
| 0 | C | — |
| −1 | E♯ | E♯ =F,Fχ=G,Gχ=A,A♯ |
| −2 | A♯ | A♯ ,E♭ |
| −3 | D♯ | D♯ ,E♯ =F,Fχ=G,G♯ ,A♯ |
| −4 | G♯ | G♯ ,A♯ ,D♭ ,E♭ |
| −5 | C♯ | C♯ ,D♯ ,E♯ =F,F♯ ,G♯ ,A♯ |
| −6 | F♯ | F♯ ,G♯ ,A♯ ,C♭ ,D♭ ,E♭ |

Column 1 gives the switch position relative to its standard position, with positive steps being to the right in FIG. 12. Column 2 gives the key tone of the major mode of the hexachord scale. Tone corrections in Table 4 are given with respect to the hexachord scale in the key of C, in hexachord notation. The conventional symbol X is used for a double sharp.

Inspection of Table 4 shows that the odd numbered positions produce a considerable number of double sharps. Moreover, the even numbered steps produce mixtures of sharps and flats. These complications cannot be entirely eliminated by use of the key selector switch, except for those simple musical compositions which are entirely contained within the hexachord scale. Fortunately, the excessive complication can be removed, while retaining the hexachord scale on the lower digitals, by a change of notation, described below.

The different keys of the hexachord scale may be considered as departures from the whole tone scale, rather than from the major mode of the hexachord scale. Table 5 shows the relationship between the whole tone notation and the hexachord notation, for the same tones. The fourth, fifth, and sixth tones F, G, A of the major mode of the hexachord scale become F♭, G♭, and A♭ in whole tone notation.

TABLE 5

| | | | | | | | | | | | | |
|---|---|---|---|---|---|---|---|---|---|---|---|---|
| Whole Tone Notation | C | D♭ | D | E♭ | F | F♭ | F | G♭ | G | A♭ | A | C♭ |
| Hexachord Notation | C | D♭ | D | E♭ | E | F | F♯ | G | G♯ | A | A♯ | C♭ |

If the pitches provided by the hexachord key selector switch are expressed as corrections to the whole tone scale, and in whole tone notation, we obtain the tone corrections of Table 6. These corrections are relatively easy to make manually—they are either all flats or all sharps, and their number is in every case three. The single key that becomes more difficult is the key of C.

TABLE 6

| Key Selector Position | Key Tone (Whole Tone Notation) | Tone Corrections (Whole Tone Notation) |
|---|---|---|
| +5 | A♯ | A♯ ,C,D♯ |
| +4 | E | A♭ ,C♭ ,D♭ |
| +3 | G♯ | G♯ ,A♯ ,C♯ |
| +2 | D | G♭ ,A♭ ,C♭ |
| +1 | F♯ | F♯ ,G♯ ,A♯ |
| 0 | C | F♭ ,G♭ ,A♭ |
| −1 | E♯ | E♯ ,F♯ ,G♯ |
| −2 | A | E♭ ,F♭ ,G♭ |
| −3 | D♯ | D♯ ,E♯ ,F♯ |
| −4 | G | D♭ ,E♭ ,F♭ |
| −5 | C♯ | C♯ ,D♯ ,E♯ |

TABLE 6-continued

| Key Selector Position | Key Tone (Whole Tone Notation) | Tone Corrections (Whole Tone Notation) |
|---|---|---|
| −6 | F | C♭ ,D♭ ,E♭ |

This simplification by a change of reference has an analogy in the theory of "The Music of the Spheres." The helicentric theory, suggested by the ancient Greeks, gained acceptance over the geocentric theory after Copernicus and Kepler showed that the apparently complicated motions of the five (visible) planets were greatly simplified when their positions were referenced to the sun, rather than the earth.

The six flatted signatures of Table 6 produce a complete set of six cyclic modes of the hexachord scale on the set 83*a* of digital leads of digital terminals, as shown in Table 7. The third column of the table gives the intertone intervals for each mode, and the fourth column the key tone of the major mode. The asterisk in the third column represents the key tone of the major mode. Similarly, the six sharped key signatures of Table 6 produce a duplicate set of the six cyclic modes on the set 83*a* of digital leads. The duplicate set of six cyclic modes is shown in Table 8. A complete set of cyclic modes is also provided by a set of six consecutive switch positions ranging from −2 to +3, or from −4 to +1.

TABLE 7

| Key Selector Position | Mode Name | Intertone Intervals | Major Key (Whole Tone Notation) |
|---|---|---|---|
| +4 | third | -2-3*2-2-1-2 | E |
| +2 | minor | -3*2-2-1-2-2 | D |
| 0 | major | *2-2-1-2-2-3 | C |
| −2 | sixth | -2-1-2-2-3*2 | A |
| −4 | fifth | -1-2-2-3*2-2 | G |
| −6 | fourth | -2-2-3*2-2-1 | F |

TABLE 8

| Key Selector Position | Mode Name | Intertone Intervals | Major Key (Whole Tone Notation) |
|---|---|---|---|
| +5 | sixth | -2-1-2-2-3*2 | A♯ |
| +3 | fifth | -1-2-2-3*2-2 | G♯ |
| +1 | fourth | -2-2-3*2-2-1 | F♯ |
| −1 | third | -2-3*2-2-1-2 | E♯ |
| −3 | minor | -3*2-2-1-2-2 | D♯ |
| −5 | major | *2-2-1-2-2-3 | C♯ |

Tone signatures corresponding to the twelve hexachord keys in whole tone notation are shown in FIGS. 14 to 25. FIGS. 14,15,16 show tone signatures corresponding to natural keynotes on the lines of the staff. In these cases the keynote is the next line above the highest flatted space. FIGS. 17,18,19 show the tone signatures for natural keynotes in the spaces of the staff. Similarly in these cases, the keynote is the next space above the highest flatted line.

FIGS. 20 to 25 show tone signatures for sharped keynotes. For all signatures with sharps, the lowest sharped note is also the keynote. A musical composition will have the same fingering in all six of the tone signatures using sharps. Similarly, it will have the same fingering in all six of the tone signatures using flats.

When the keyboard player encounters the whole tone scale sign with the hexachord tone signature of FIGS. 14 to 19, he depresses pushbutton 12 of the scale selector, and sets the hexachord key selector to the appropriate position. Thereafter he plays on the front digitals. If then in the music he comes to a natural sign, he plays it as a flat, to the left of the indicated digital. On the other hand a singer, or a musician playing an instrument without a key selector, would read the natural sign to be sung or played a semitone higher than the signature-flatted note.

If, instead of depressing the hexachord pushbutton 12 of the scale selector, the whole tone pushbutton 11 is depressed, then the twelve hexachord tone signatures must be actuated manually. This is not difficult, because the hexachord scale can be played at all positions on the whole tone keyboard with only two different fingerings. It seems likely that most new music could be written with just one fingering — with the hexachord scale always starting on a front digital, or with it always starting on a back digital.

Singers trained in the standard hexachord notation easily adapt to the six tone signatures for the keys of C,E,G,C♯ ,E♯ ,G♯ because these keys retain the tones of the tonic major triad on the lines of the staff and the tones of the supertonic minor triad in the spaces. With the increasing availability of pitch changers it appears that many musical needs would be satisfied by just the group of three flatted keys C,E,G, or by just the group of three sharped keys C♯ ,E♯ ,G♯ .

Whole tone notation with different hexachord tone signatures appears to provide an improved system for playing musical instruments without pitch changers. In stringed instruments, for example, the whole tone scale corresponds to regular shortening of the string length; the hexachord tone signature then emphasizes the nature of the hexachord as an irregular scale departing in a simple and consistent manner from the regular spacing. The shapes of all twelve tone signatures are the same, so the signatures are easy to remember and to finger.

I have examined other S-tone musical scales, but have shown key signature actuators only for the case S=6 (hexachord scale) and S=7 (diatonic scale). The case S=8 is also of interest. A regular 8-tone scale may be fitted to the front digitals of a keyboard if the four back digitals are equally spaced, with two front digitals between consecutive back digitals. When all tones are played on the keyboard in their natural order, the front digitals play a regular 8-tone musical scale defined by the sequence of intertone intervals 2-1-2-1-2-1-2-1 semitones. This scale includes the important musical intervals of fourths and fifths.

A transcendent irregular 8-tone scale is obtained by augmenting the diatonic scale with either the B♭ tone or the F♯ tone. These alternative extensions produce two different modes of the same octachord scale. Another way of expressing this relation is to say that the octachord scale includes two diatonic scales spaced by a fifth (just as the diatonic scale includes two hexachords spaced by a fifth and the hexachord includes two tonal pentatonic scales spaced by a fifth). One mode of the octachord scale is defined by the sequence of intertone intervals 2-2-1-1-1-2-2-1 semitones; the regular 8-tone scale is converted to this mode by a tone signature with one sharp and one flat.

Eight-tone scales ave fingering and notational advantages over seven-tone scales, but they are not as compatible as six-tone scales with the traditional system of five-line staves and homogeneous key signatures.

We now refer to FIG. 27 showing a scale selector switch. Input tone terminals 28, individually identified by the conventional tone labels, are connected to contact arrays 21,22,23 by means of input leads 85. Output leads 29 bear conventional labels for the tones they carry when pushbutton 11 is depressed, (providing that the pitch selector and key selectors are set to their standard states). Output leads 29 are permanently connected to a sequence of fourteen chains of frequency dividers 2. These chains have the traditional tone labels except for two extra chains labeled E♯ and B♯ . The B♯ chain is non-functional when the key selector is in its standard position, but it is needed when the diatonic key selector is set to other positions, which actuate flats or sharps.

Pushbutton 11 closes the array of contacts 21, pushbutton 12 closes the array of contacts 22, pushbutton 13 closes the array of contacts 23. When one pushbutton is depressed, it latches down and the previously latched pushbutton is released. Only one pushbutton can be latched down at a time.

The fourteen input leads 85 to the scale selector are coupled to the fourteen output leads of the diatonic key selector, individual leads being coupled in accordance with the individual labels of input leads 85 of FIG. 27 and of output terminals 51 of FIG. 7.

The fourteen output leads 29 of the scale selector switch are coupled to the audio inputs 86 of fourteen chains of dividers 2. Outputs from the dividers are coupled to the digital switches 6,7 (attached to the digitals of the keyboard) shown in FIG. 28.

Figure 28:
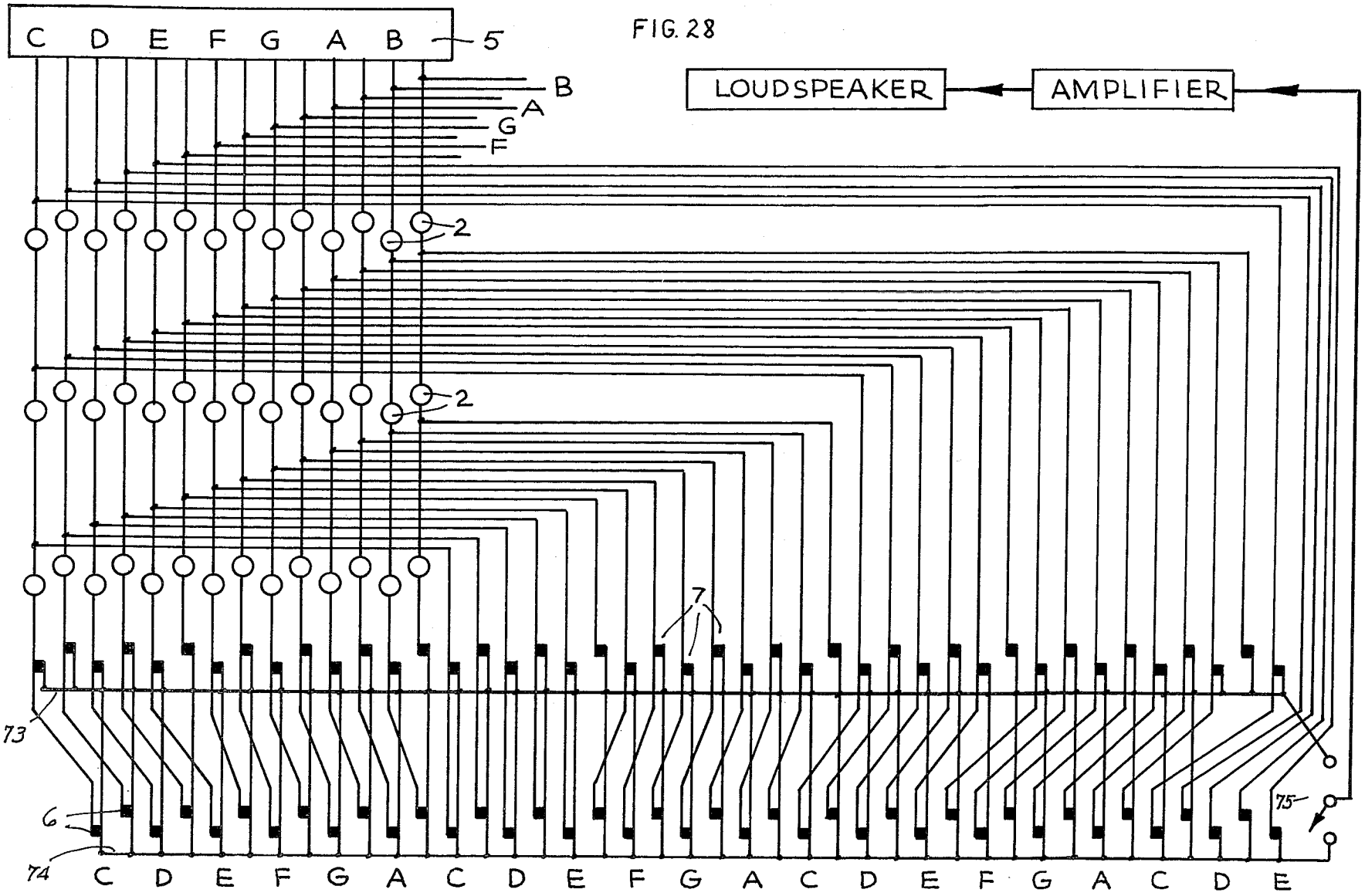

When playing in the diatonic scale, pushbutton 11 of FIG. 27 is depressed and switch 75, shown in FIGS. 4 and 28, is set to the diatonic position.

To play in the hexachord scale, switch 75 of FIG. 28 is set to the hexatonic position and pushbutton 12 or 13 of FIG. 27 is depressed, with the diatonic key selector in its standard position. If pushbutton 11 of FIG. 27 is now depressed, the secondary tones C,D,E,G-♭ ,A♭ ,B♭ of the whole tone scale will be played by the front digitals of the keyboard. This scale has no need for a key selector.

The tones generated by the fourteen chains of dividers when the different pushbuttons are depressed are shown in Table 9. The headings of the columns are the labels of the fourteen chains of dividers. Conventional labels are used for the tones.

The tones F♯, G♯, A♯ are identical with the tones G♭, A♭, B♭, respectively.

Table 9

| Push-button | Scale | C | C♯ | D | D♯ | E | E♯ | F | F♯ | G | G♯ | A | A♯ | B | B♯ |
|---|---|---|---|---|---|---|---|---|---|---|---|---|---|---|---|
| | Diatonic | | | | | | | | | | | | | | |
| 11 | Wholetone | C | C♯ | D | D♯ | E | — | F | F♯ | G | G♯ | A | A♯ | B | — |
| 12 | Hexachord | C | C♯ | D | D♯ | E | — | F♯ | F | G♯ | G | A♯ | A | B | — |

Table 9-continued

| Push-button | Scale | C | C# | D | D# | E | E# | F | F# | G | G# | A | A# | B | B# |
|---|---|---|---|---|---|---|---|---|---|---|---|---|---|---|---|
| 13 | Hexachord | C | C# | D | D# | E | — | A# | F | F# | G | G# | A | B | — |

For teaching beginners, I prefer the hexachord arrangement obtained by pushbutton 13, with eleven tones positioned on the keyboard in their natural order. The twelfth tone, A , may be played by the spare back digital between the E and F digitals. For beginners, the complication of the tone signature may be avoided by using the hexachord scale sign (without tone signature) together with the pitch changing switch.

In all switch states, pitches played by the front digitals always increase from left to right. However, at least one tone activated by a back digital must be positioned out of its natural order. Of all hexatonic scales, only the whole tone scale can have all twelve tones of the chromatic scale positioned in their natural order.

For general use, the most satisfactory arrangement is to have one hexachord scale on the front digitals of the keyboard and a second hexachord scale on the back digitals of the keyboard. This arrangement is produced by depressing pushbutton 12. Referring to Table 9, we see that tones F# , G# ,A# are positioned to the left of the tones F,G,A instead of to their right. This pushbutton is depressed when the hexachord key selector is to be used. The hexachord key selector operates as if it were directly connected to the frequency dividers.

The outputs from the frequency dividers couple the hexachord tones C,D,E,F,G,A to the front digitals and the tones C# ,D# ,F# ,G# ,A# ,B to the back digitals. The tones on the back digitals constitute a second hexachord scale, with the major mode starting on F .

Referring now to FIG. 28, the output leads from scale selector 5 are connected to the inputs of fourteen chains of dividers 2. Electrical outputs from several stages of the fourteen chains of dividers 2 are carried to two separate sets of digital switches. The diatonic set 7 and the hexatonic set 6 both pass these electrical signals to their respective bus bars 73 and 74. A bus selector switch 75 selects one of these two bus bars to be connected to the bus amplifier and loudspeaker.

Inspection of FIG. 28 shows that the output of each divider is permanently connected to two digital switches. Only one of these digital switches is functional for a particular position of the bus selector switch 75. There are five digitals on the keyboard which play the same tone for both positions of switch 75. These are the middle C digital and the next four digitals above it. Thus a single digital switch would suffice for these five digitals.

Referring again to FIG. 27, tone terminals 28 may be connected to the tone generator circuits directly, or via other switches, as shown in FIG. 4. The intervention of the pitch changer switch has no effect except to raise or lower the absolute pitch of the musical output. The intervention of the key selectors will have no effect when they are in their standard position.

Figure 26:
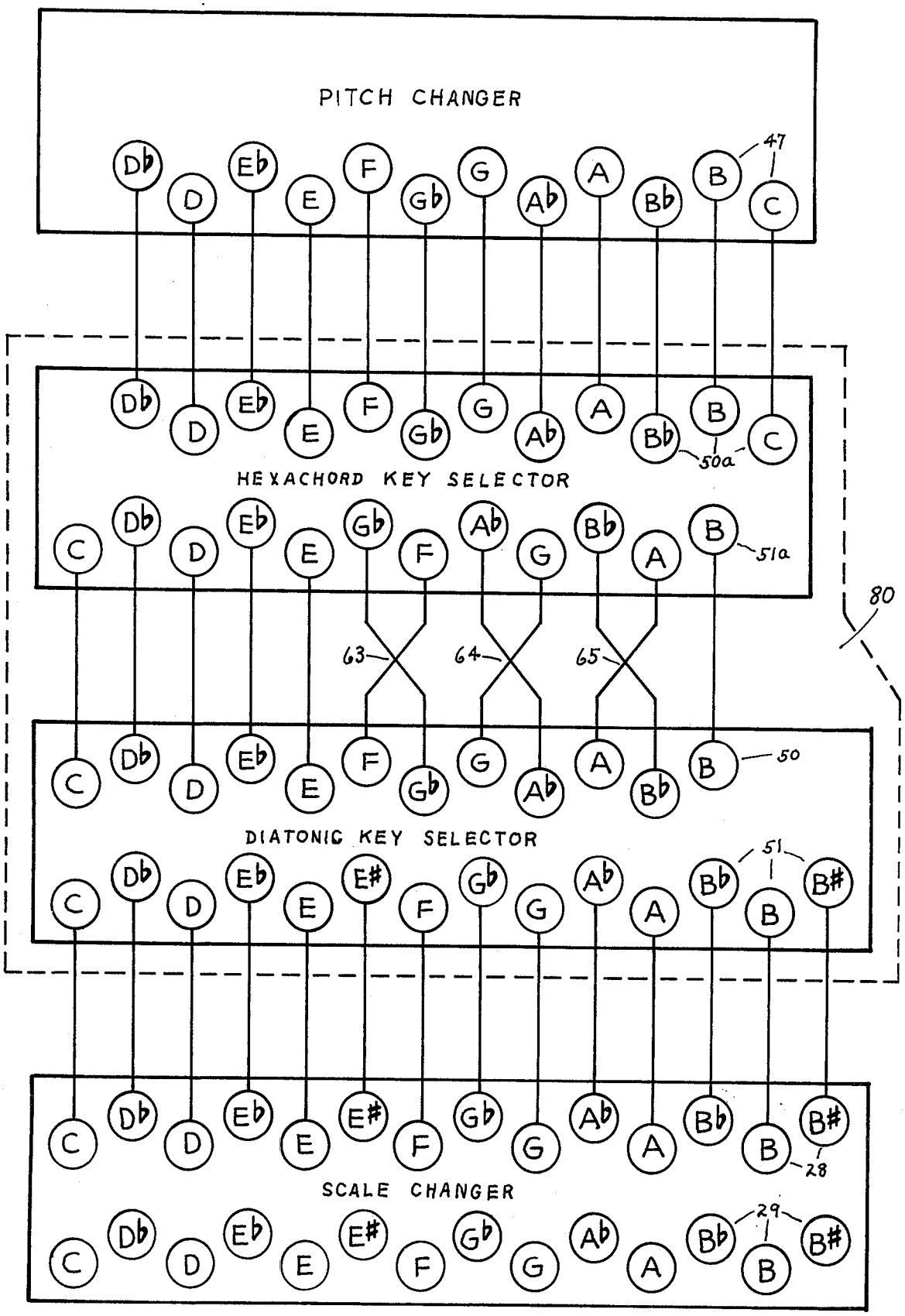
FIG. 26 is a connection diagram for my tone transposition apparatus.

The different parts of my tone transposition apparatus, including the pitch changer, the key selectors, and the scale selector, are connected together as shown in FIG. 26. Tone terminals of each part are connected to the digital terminals of the preceding part with the same terminal labels. Hexachord key selector output terminals 51*a* are connected to diatonic key selector input terminals 50. This arrangement results in connection crossovers 63,64,65 within the key selector system 80, shown within dotted lines. These crossovers are positioned to correspond to the standard position of the hexachord key selector, and it is necessary for the hexachord key selector to be in its standard position when the diatonic scale is in use.

When the hexachord scale is in use, it is necessary for the diatonic key selector to be in its standard position, where it will have no effect. The effect of the three connecting wire crossovers 63,64,65 is then undone by the scale selector switch.

OTHER EMBODIMENTS

Figure 29:
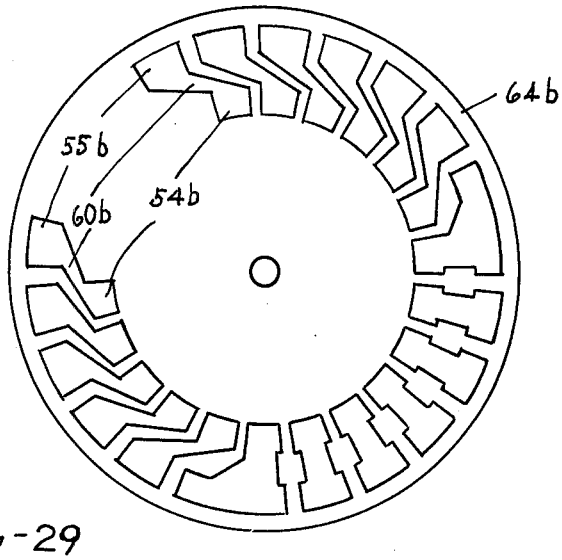
FIGS. 29, 30 diagram an alternative embodiment of my invention.
Figure 30:
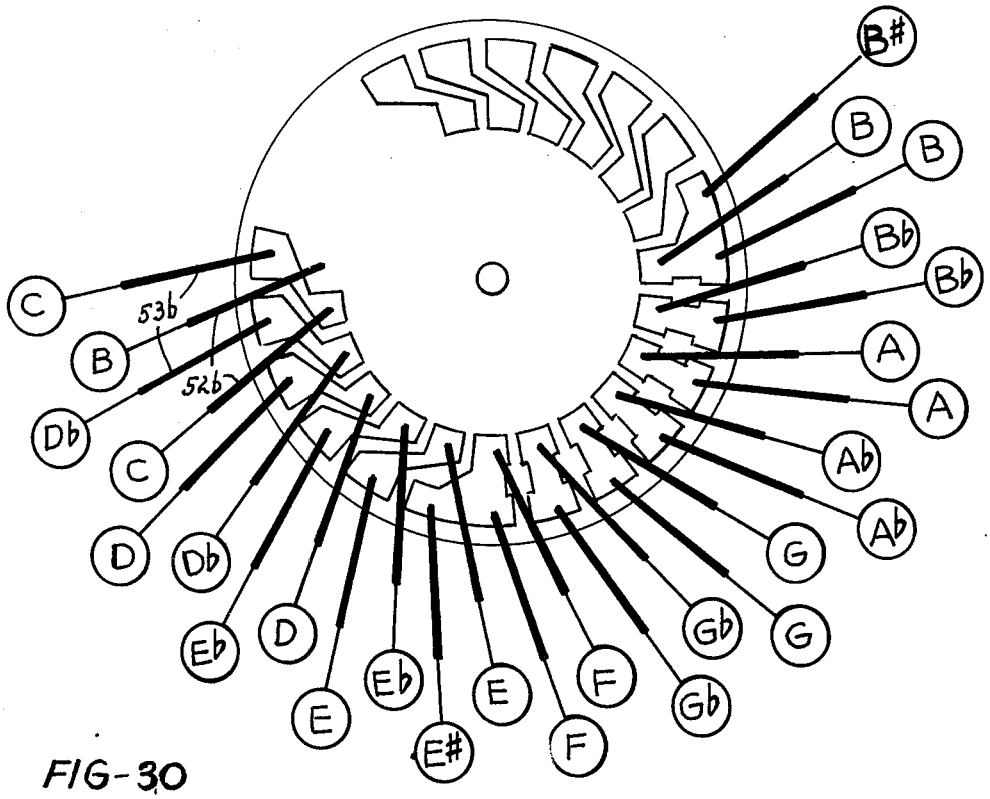

The principal feature in my key selector switches is that two interconnected linear arrays of movable contacts slide along two linear arrays of stationary contacts. The contacts in a linear array do not necessarily form a straight line: they may form an arc of a circle, or even a helix. FIGS. 29 and 30 diagram a rotary version of the diatonic key selector switch shown in FIG. 7. The straight line of movable tone contacts 54 of FIG. 7 becomes the circle of movable tone contacts 54*b* of FIG. 29. The straight line of movable digital contacts 55 of FIG. 7 becomes the circle of movable digital contacts 55*b* of FIG. 29. The interconnections 60*b* between movable contacts of FIG. 29 are exactly the same as the interconnections 60 of FIG. 7. The movable carriage 64 of FIG. 7 becomes the rotor 64*b* of FIG. 29.

The two straight lines of stationary contacts 52,53 of FIG. 7 become the two circles of stationary spring contacts 52*b*,53*b* of FIG. 30. These are attached to the bottom side of a stationary circuit board, and they make contact with the arrays of movable contacts in the same way as in FIG. 7. In FIG. 30, the center-to-center spacing between adjacent contacts is sixteen degrees.

The hexachord key selector switch of FIG. 12 can similarly be produced in a rotary form.

Figure 11:
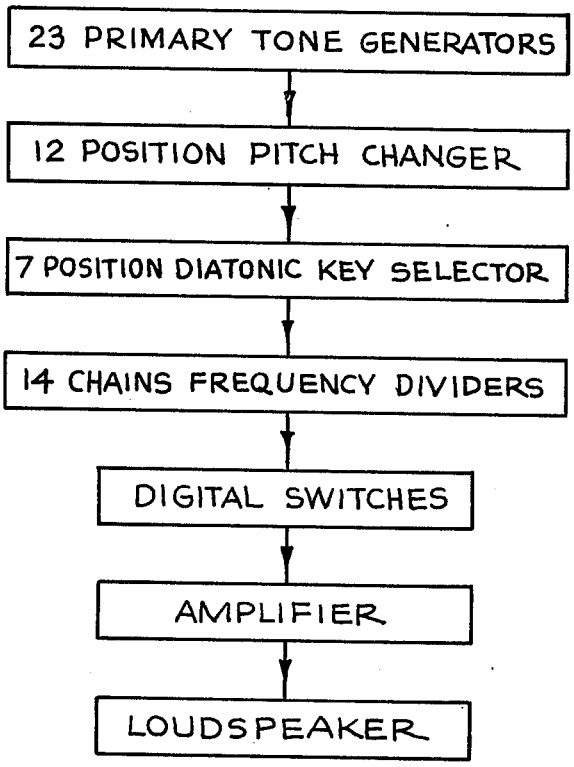
FIG. 11 is a block diagram for an alternative embodiment.

The combination of key selector and pitch changer can be installed in a purely diatonic instrument, as diagramed in FIG. 11. In FIG. 11 the diatonic key selector is coupled to the primary tone generators via the pitch changer switch, without the intervention of the hexachord key selector switch. The hexachord key selector shown in FIG. 4 is replaced by permanent wiring corresponding to the standard state of the hexachord key selector. In this case the standard position of the pitch changer should be set one step lower, so that its absolute output pitches range from C up eleven steps to B.

The diatonic key selector is also coupled to the diatonic digital switches via the fourteen chains of frequency dividers, without the intervention of a scale selector switch, the busbar output from the diatonic digital switches being permanently connected to the amplifier and loud-speaker. Thus the front digitals of the keyboard always play tones of the diatonic scale.

The primary tone generators, pitch changer, key selector, frequency dividers, and diatonic digital switches, are the same as those shown in FIG. 4; individual leads of adjacent components being connected together according to the identifying labels on the corresponding input and output terminals.

My tone transposition apparatus is designed in modular form, so that either key selector may be omitted. If the hexachord key selector is omitted, the twelve tone terminals 50 of FIG. 7 may be connected directly to the twelve digital terminals 47 of FIG. 6, without any connection crossovers. If the diatonic key selector and the scale selector are also omitted, the twelve digital terminals 47 of FIG. 6 may be connected directly to their corresponding twelve chains of frequency dividers 2 of FIG. 27 or 28.

In the preferred embodiment, audio frequency currents pass through the two sets of digital switches. In other embodiments the audio frequency currents may pass through solid state relay switches which are in turn activated by D.C. currents passed by the digital switches. Such solid state switching is commonly used in the electronic organ industry. My invention can be connected equally well to digital switches and to remote digitally controlled switches.

I claim:

1. An electrically keyed musical instrument having a keyboard containing a total of at least 25 front and back digitals, each front digital operating at least one front digital switch, each back digital operating at least one back digital switch, a plurality of tone generator circuits tunable in an approximately equitempered scale with twelve equal intertone intervals per octave, each equal to one semitone, signal transmission means between said tone generator circuits and said digital switches such that an irregular hexatonic scale is played on said front digitals of said keyboard with an octave span containing exactly six front digitals and at least three back digitals, key selector means having a standard state and at least one non-standard state, wherein the improvement comprises:

in said standard state, a predetermined mode of said irregular hexatonix scale is played on six consecutive front digitals of said keyboard, starting with a predetermined front digital, in said non-standard state, said predetermined mode of said irregular hexatonic scale is played at a lower or higher absolute pitch on six consecutive front digitals of said keyboard, starting with a front digital which is the first, second, or third lower digital to the left or right of said predetermined front digital.

2. An electrically keyed musical instrument having a set of tone generator circuits providing tones in an approximately equitempered scale with twelve tones per octave including, a first subset of said tone generator circuits providing tones in a musical scale with at least six tones per octave, and a second subset of said tone generator circuits providing tones intermediate to the tones of said first subset, a keyboard having at least six front digitals and at least three back digitals per octave span, each digital activates at least one digitally controlled switch, an improved key selector switch having a standard position and a plurality of non-standard positions, in said standard position said front digitals being adapted to activate said first subset of tone generator circuits, in any one of said non-standard positions one or more of said front digitals being adapted to activate one or more members of said second subset of tone generator circuits, wherein the improvement comprises:

a first linear array of at least twelve stationary contacts, insulated from each other, each connected to a different one of said set of tone generator circuits, a second linear array of at least nine stationary contacts, insulated from each other, each connected to a different one of said digitally controlled switches, a movable carriage, a first linear array of at least nine movable contacts mounted on said movable carriage, insulated from each other, sliding along and in electrical contact with said first linear array of stationary contacts, a second linear array of at least nine movable contacts mounted on said movable carriage, insulated from each other, sliding along and in electrical contact with said second linear array of stationary contacts, at least nine movable electrical conductors mounted on said movable carriage, insulated from each other, each connecting a different member of said second linear array of movable contacts to a single member of said fist linear array of movable contacts.

3. The musical instrument of claim 2 in which said first subset of tone generator circuits provides seven tones per octave and said second subset of tone generator circuits provides five tones per octave.

4. The musical instrument of claim 2 in which said first subset of tone generator circuits provides six tones per octave and said second subset of tone generator circuits provides six tones per octave.

5. The musical instrument of claim 2 in which: said first and second linear arrays of stationary contacts are arranged in first and second parallel straight lines respectively, said first and second linear arrays of movable contacts are arranged in two parallel straight lines which are parallel to said first and second straight lines.

6. The musical instrument of claim 2 in which: said first linear array of stationary contacts is arranged in a first arc of a circle, said second linear array of stationary contacts is arranged in a second arc of a circle coaxial with said first arc of a circle, said first linear array of movable contacts is arranged in an arc of a circle coaxial with said first arc of a circle, said second linear array of contacts is arranged in an arc of a circle coaxial with said second arc of a circle.

7. The musical instrument of claim 6 in which: adjacent members of said first linear array of stationary contacts are spaced by a fixed center-to-center angle a, adjacent members of said first linear array of movable contacts are spaced by said center-to-center angle a.

8. Apparatus for physically actuating the tone signatures of musical compositions in the hexachord scale comprising:

six digitals for playing individual musical tones, said digitals arranged in a single predetermined sequence, a key selector switch having a least first and second switch states corresponding to different hexachord tone signatures, said key selector electrically coupled to each of said six digitals, in said first state of said key selector, said sequence of six digitals playing six tones arranged in a first sequence in order of increasing pitch, successive members of said sequence of digitals playing tones of successively higher pitch, said first sequence of tones being the major mode of the hexachord scale defined by the set of intertone intervals 2-2-1-2-2-3 semitones, in said second state of said key selector, said sequence of six digitals playing six tones arranged in a second sequence in order of increasing pitch, successive members of said sequence of digitals playing tones of successively higher pitch, said second sequence of tones being a cyclic mode of the hexachord scale defined by a sequence of intertone intervals selected from the group consisting of:

3-2-2-1-2-2 semitones,
2-3-2-2-1-2 semitones,
2-2-3-2-2-1 semitones,
1-2-2-3-2-2 semitones,
2-1-2-2-3-2 semitones.

9. Apparatus for physically actuating the diatonic key signature of musical compositions, and for uniformly changing the absolute pitch of the musical output relative to that normally associated with the digitals struck, the combination comprising:

seven digitals for playing individual musical tones, said digitals arranged in a predetermined sequence, a key selector switch having at least first and second switch states corresponding to different diatonic key signatures, said key selector electrically coupled to each of said seven digitals, a pitch changer switch having at least four different switch states, corresponding to different absolute pitches of the tone played by the first digital of said sequence, said pitch changer being electrically coupled to each of said seven digitals, in said first state of said key selector, said sequence of seven digitals playing seven tones arranged in a first sequence in order of increasing pitch, successive members of said sequence of digitals playing tones of successively higher pitch, said first sequence of tones being the major mode of the diatonic scale defined by the sequence of intertone intervals 2-2-1-2-2-2-1 semitones, the relative pitches within said first sequence of tones being the same for all four states of said pitch changer, the absolute pitches of said first sequence of tones being different for all four of said states of said pitch changer, in said second state of said key selector, said sequence of seven digitals playing seven tones arranged in a second sequence in order of increasing pitch, successive members of said sequence of digitals playing tones of successively higher pitch, said second sequence of tones being a cyclic mode of the diatonic scale defined by a sequence of intertone intervals selected from the group consisting of:

1-2-2-1-2-2-2 semitones,
2-1-2-2-1-2-2 semitones,
2-2-1-2-2-1-2 semitones,
2-2-2-1-2-2-1 semitones,
1-2-2-2-1-2-2 semitones,
2-1-2-2-2-1-2 semitones, the relative pitches within said second sequence of tones being the same for all four states of said pitch changer, the absolute pitches of said second sequence of tones being different for all four of said states of said pitch changer.

10. Apparatus for physically actuating the key signature of musical compositions comprising:

a set of at least twelve primary tone generator circuits which generate the twelve tones of dodecuple scale, said twelve tone generator circuits arranged in a single sequence in order of increasing pitch, with intertone intervals of a single semitone between consecutive members of said sequence, switching means having at least first and second switch states corresponding to different key signatures, having input leads equal in number to said primary tone generator circuits, individual input leads coupled to individual ones of said primary tone generator circuits, said switching means having S output leads, where S is a selected integer in the range six to eight inclusive, a set of S chains of frequency divider circuits arranged in a predetermined sequence, each chain having a single audio input lead, in said first and second switch states, individual output leads from said switching means coupling different cyclic modes of an S-tone musical scale to individual audio input leads of said S chains of frequency divider circuits, the tones of said different cyclic modes being selected from the tones generated by said primary tone generator circuits.

11. The apparatus of claim 10 in which said selected integer S is equal to seven, said S-tone musical scale is the diatonic scale, in said first switch state, a first subset of seven of said primary tone generator circuits being coupled to said seven chains of frequency divider circuits, said seven primary tone generator circuits being arranged in a first sequence in order of increasing pitch, generating tones of the major cyclic mode of the diatonic scale, defined by the sequence of intertone itervals 2-2-1-2-2-2-1 semitones, said first sequence of tone generator circuits generating the relative pitches conventionally labled C-D-E-F-G-A-B, in said second switch state, a second subset of seven of said primary tone generator circuits being coupled to said chains of frequency divider circuits, said second subset of seven primary tone generator circuits being arranged in a second sequence in order of increasing pitch, generating tones of a different cyclic mode of the diatonic scale, said different cyclic mode being a conventional sequence of relative pitches selected from the group consisting of:

C-D-E-F-G-A-B♭,
C-D-E♭-F-G-A-B♭,
C-D-E♭-F-G-A♭-B♭,
C-D♭E♭-F-G-A♭-B♭,
C-D♭-E♭-F-G♭-A♭-B♭,
-C♭-D♭-E♭-F-G♭-A♭-B♭, said different cyclic mode defined by a sequence of intertone intervals selected from the group consisting of:

2-2-1-2-2-1-2 semitones,
2-1-2-2-2-1-2 semitones,
2-1-2-2-1-2-2 semitones,
1-2-2-2-1-2-2 semitones,
1-2-2-1-2-2-2 semitones, 2-2-2-1-2-2-1 semitones.

12. The apparatus of claim 10 in which said selected integer S is equal to six, said S-tone musical scale is the hexachord scale, in said first switch state, a first subset of six of said primary tone generator circuits being coupled to said six chains of frequency divider circuits, said six primary tone generator circuits being arranged in a first sequence in order of increasing pitch, generating tones of the major cyclic mode of the hexachord scale, defined by the sequence of intertone intervals 2-2-1-2-2-3 semitones, said first sequence of tone generator circuits generating the relative pitches conventionally labled C-D-E-F-G-A, in said second switch state, a second subset of six of said primary tone generator circuits being coupled to said chains of frequency divider circuits, said second subset of six primary tone generator circuits being arranged in a second sequence in order of increasing pitch, generating tones of a different cyclic mode of the hexachord scale defined by a sequence of intertone intervals selected from the group consisting of:

3-2-2-1-2-2 semitones,
2-3-2-2-1-2 semitones,
2-2-3-2-2-1 semitones,
1-2-2-3-2-2 semitones,
2-1-2-2-3-2 semitones.

13. A method for physically actuating the diatonic key signature of musical compositions on an electronic musical instrument, the improvement comprising:

electronically generating a set of primary tone signals including at least first and second subsets corresponding to different key signatures, the members of said first subset of primary tone signals being arranged in a first sequence in order of increasing pitch, having the relative pitches of a first cyclic mode of the diatonic scale, said first cyclic mode consisting of a sequence of seven relative tones selected from the group of conventionally labeled sequences:

C-D-E-F-G-A-B,
B-C-D-E-F-G-A,
A-B-C-D-E-F-G, said first cyclic mode defined by a sequence of intertone intervals selected from the group consisting of:

2-2-1-2-2-2-1 semitones,
1-2-2-1-2-2-2 semitones,
2-1-2-2-1-2-2 semitones, the members of said second subset of primary tone signals being arranged in a second sequence in order of increasing pitch, having the relative pitches of a second cyclic mode of the diatonic scale, said second cyclic mode defined by a sequence of intertone intervals selected from the group consisting of:

2-2-1-2-2-1-2 semitones,
2-2-2-1-2-2-1 semitones,
1-2-2-2-1-2-2 semitones,
2-1-2-2-2-1-2 semitones, arranging seven chains of frequency divider circuits in a predetermined sequence, each chain of frequency divider circuits having a single audio input, selectively coupling one of said cyclic modes of the diatonic scale to the seven audio inputs of said chains of frequency divider circuits, individual tones of said one cyclic mode being coupled to individual audio inputs.

14. A method for physically actuating the hexachord tone signature of musical compositions on an electronic musical instrument, the improvement comprising:

electronically generating a set of primary tone signals including at least first and second subsets of six primary tone signals, said first and second subsets corresponding to different tone signatures, the members of said first subset of primary tone signals being arranged in a first sequence in order of increasing pitch, having the six relative pitches conventionally labeled C,D,E,F,G,A of the major cyclic mode of the hexachord scale, said mode defined by the sequence of intertone intervals 2-2-1-2-2-3 semitones, the members of said second subset of primary tone signals being arranged in a second sequence in order of increasing pitch, said second sequence of primary tone signals being a different cyclic mode defined by a sequence of intertone intervals selected from the group consisting of:

3-2-2-1-2-2 semitones,
2-3-2-2-1-2 semitones,
2-2-3-2-2-1 semitones,
1-2-2-3-2-2 semitones,
2-1-2-2-3-2-semitones, arranging six chains of frequency divider circuits in a predetermined sequence, each chain of frequency divider circuits having a single audio input, selectively coupling one of said cyclic modes of the hexachord scale to the six audio inputs of said chains of frequency divider circuits.

* * * * *